United States Patent [19]

Sumin

[11] Patent Number: 4,784,394

[45] Date of Patent: Nov. 15, 1988

[54] TOURIST GAME APPARATUS

[76] Inventor: Vitaly Sumin, 637, S. Hauser Blvd., #22, Los Angeles, Calif. 90036

[21] Appl. No.: 34,542

[22] Filed: Apr. 6, 1987

[51] Int. Cl.[4] ..... A63F 3/04

[52] U.S. Cl. ..... 273/251; 273/254

[58] Field of Search ..... 273/251, 252, 254, 243, 273/248, 249, 240; 434/150, 153; 283/34, 35

[56] References Cited

U.S. PATENT DOCUMENTS

| | | | |
|---|---|---|---|
| 3,799,551 | 3/1974 | Erickson | 273/252 |
| 3,947,038 | 3/1976 | Archer | 273/254 |

FOREIGN PATENT DOCUMENTS

| | | | |
|---|---|---|---|
| 2398524 | 3/1979 | France | 273/251 |
| 137890 | 1/1920 | United Kingdom | 273/249 |

*Primary Examiner*—Richard C. Pinkham
*Assistant Examiner*—William E. Stoll

[57] ABSTRACT

A board game apparatus designed to guide and educate the players about the geography, transportation, historical, social, entertainment and amusement interests in combination with the shopping, restaurants and hotel accomodations available in an existing area. The apparatus includes a board comprising at least one map bearing the geographical indicia characterizing the area wherein are displayed the geographical locations of the selected tourist attractions usually matched with the services. There is a plurality of playing cards containing essential information about these locations which are connected on the map by the separate itineraries of travel dedicated, each of them to a different player. Each player is authorized to leave temporarily an individual itinerary and to perform a trip according to existing means of transportation and the distances within the area. The information provided by the playing cards is disclosed to all players during the course of playing the game serving for formulating the questions at the end of the play; correct answers to these questions help to determinate one of the winners. The second winner is selected by chance. Each player is provided by a token being moveable for travel. There are also at least two cards designed for surprise and awarded to the winners.

10 Claims, 14 Drawing Sheets

FIG. 5

77.a 8.a 9.a 10.a 11.a 12.a

| STATIONS # | ITINERARIES | | | | | |
|---|---|---|---|---|---|---|
| | RED [GRAND CANYON COLORADO RIVER COUNTRY] | ORANGE [NORTHERN ARIZONA] 20 | VIOLET [FROM INDIAN COUNTRY TO LOST DUTCHMAN MINE - VIA MOUNTAIN COUNTRY AND SOUTHERN ARIZONA] | YELLOW [GREATE PHOENIX] 20 | GREEN [WELCOME TO TUCSON!] | |
| 1 | MARBLE CANYON -Lees Ferry -Navaho Bridge ( 2 Cards ) | WILLIAMS ( I Card ) 99 | PAGE -Lake Powell ( I Card ) 14 | MESA 14.a -Mormon Temple ( I Card ) | NOGALES ( I Card ) | |
| 2 | NORTH RIM ( I Card ) 99 14 | FLAGSTAFF -The City & principal museums. -Lowell Observatory -Walnut Canyon ( 3 Cards ) | NAVAJO NATIONAL MONUMENT ( I Card ) | TEMPE -Arizona State University ( I Card ) | ST.HAVIER DEL BAC ( I Card ) | |
| 3 | SOUTH RIM -Phantom Ranch -Grand Canyon Village -Watch Tower ( 3 Cards ) | FLAGSTAFF -Wupataki Ruins -Sunset Crater ( 2 Cards ) | MONUMENT VALLEY ( I Card ) | SCOTTSDALE -Center for the Arts -City Hall -Old Scottsdale ( 3 Cards ) | TUCSON -The City -Old Tucson ( 2 Cards ) | |
| 4 | KINGMAN -Lake Mead Recr.Area -Oatman ( 2 Cards ) | SEDONA -Oak Creek Canyon -Montezuma Castle -Tuzigot Nat.Mon. ( 3 Cards ) | CANYON DE CHELLY ( I Card ) | SCOTTSDALE -Taliesin West ( I Card ) | ARIZONA SONORA MUSEUM ( I Card ) | |
| 5 | BULLHEAD CITY -Lake Mohave ( I Card ) | JEROME ( I Card ) 99 | WINDOW ROCK ( I Card ) | SCOTTSDALE -Railroad Park ( I Card ) | SAGUARO NATL.MONUMENT ( I Card ) | |
| 6 | LAKE HAVASU CITY -The City -London Bridge ( 2 Cards ) | PRESCOTT -The City -Charlot Hall Museum ( 2 Cards ) | WHITE MOUNTAINS -The Country -Show Low ( 2 Cards ) | PHOENIX -Camelback Mountain ( I Card ) | TUCSON -DeGrazia Art & Cultural Foundation ( I Card ) | |
| 7 | PARKER ( I Card ) | WICKENBURG -"Ranch Capital of the World" -Frontier Street ( 2 Cards) | DOUGLAS -Chiricahua Natl. Monument ( I Card ) | PHOENIX -Metrocenter ( I Card ) | TUCSON -Fort Lowell ( I Card ) | |
| 8 | YUMA - The City -The Prison ( 2 Cards ) 14 | ---------- | BISBEE ( I Card ) | PHOENIX -Heard Museum -Phoenix Art Museum ( 2 Cards ) | TUCSON - UNIV. OF AZ. -Arizona State Museum -Museum of Art -Flandrau Planetarium ( 3 Cards ) | |
| 9 | ----- 14.a | ---------- | SIERRA VISTA AREA ( I Card ) | PHOENIX -Civic Plaza -Heritage Square ( 2 Cards ) | DOWNTOWN TUCSON -La Casa Cordova -Pima County Court House. ( 2 Cards ) | |
| 10 | ---------- | ---------- | TOMBSTONE -The City -Famous Places ( 2 Cards ) | PHOENIX -Hall of Flame ( I Card ) | TUCSON INTERNATIONAL AIRPORT ( I Card ) | |
| 11 | ---------- | ---------- | MESA -Lost Dutchman Mine -Roosevelt Dam ( 2 Cards ) | ---------- | ---------- | |
| SKY HARBOR AIRPORT | F | I | N | I | S | H |

77.a 8.a 9.a 10.a 12.a 11.a

| STATIONS # | ITINERARIES | | | | | |
|---|---|---|---|---|---|---|
| | RED [DOWNTOWN] 20 | ORANGE [MIDTOWN] 20 | VIOLET [UPTOWN] N.Y. MAJOR MUSEUMS | GREEN TRANSPORTATION TERMINALS | YELLOW CIRCLE LINE 20 | |
| 1 | LIBERTY ISLAND ( I Card ) 99 | JACOB JAVITS CENTER ( 2 Cards ) | GUGGENHEIM MUSEUM ( 2 Cards ) | 30TH STREET (W) HELIPORT ( I Card ) | PIER 83 ( I Card ) | |
| 2 | N.Y.STOCK EXCHANGE ( 2 Cards ) | THEODOR ROOSVELT BIRTHPLACE ( I Card ) | CENTRAL PARK /Delacorte Theater ( I Card ) | MADISON SQUARE GARDEN, PENN STATION ( 2 Cards ) | LIBERTY ISLAND ( 2 Cards ) | |
| 3 | WORLD TRADE CENTER ( 2 Cards ) | POLICE MUSEUM ( I Card ) | MUSEUM OF NATURAL HISTORY ( 2 Cards ) | ISLAND HELIPORT ( 2 Cards ) | a.BROOKLIN BRIDGE. b.MANHATTAN BRIDGE. ( 2 Cards ) | |
| 4 | SOUTH STREET SEEPORT ( 2 Cards ) | UNITED NATIONS ( 2 Cards ) | METROPOLITAN MUSEUM ( 2 Cards ) | EAST SIDE AIRLINE TERMINAL ( 2 Cards ) | UNITED NATIONS ( 2 Cards ) | |
| 5 | CHINA TOWN 99 ( 2 Cards ) | a.ROCKEFELLER CENTER. b.ST.PATRICK CATHEDRAL. ( 3 Cards) | a.WHITNEY MUSEUM b. FRICK COLLECTION ( 2 Cards ) | GRAND CENTRAL ( 2 Cards ) | GRACIE MANSION ( 2 Cards ) | |
| 6 | SOHO ( 2 Cards ) | LINCOLN CENTER ( 2 Cards ) | CENTRAL PARK - ZOO ( I Card ) | a.SUBWAY EXPRESS TO J.F.K. AIRPORT b.N.Y. CONVENTION AND VISITORS BUREAU ~~( 2 Cards)~~ | MORRIS JUMEL MANSION ( I Card ) | |
| 7 | GREENWICH VILLAGE ( 2 Cards ) | TIMES SQUARE AND BROADWAY ( 3 Cards ) | a.TRUM TOWER. b.MUSEUM OF MODERN ART c.BROADCASTING (3 Cards) MUSEUM | PASSENGER SHIP TERMINAL ( I Card ) | GEORGE WASHINGTON BRIDGE ( 2 Cards ) | |
| 8 | EAST VILLAGE ( I Card ) | ---------- | CITICORP CENTER ( I Card ) | PORT AUTHORITY BUS TERMINAL ( 2 Cards ) | a.GENERAL GRANT NATIONAL MEMORIAL. b. RIVERSIDE CHURCH. ( 2 Cards ) | |
| EMPIRE STATE BUILDING | F I N I S H | | | | | |

14 14

FIG. 6

TOURIST GAME APPARATUS

BACKGROUND OF THE INVENTION

The present invention relates generally to board games and, especially, to the educational travel games designed for pleasure dealing with maps of the existing places.

References may be made to U.S. Pat. Nos. 3,638,946; 3,851,881; 3,883,142; 4,093,235; 4,095,800; 4,411,432. The U.S. Pat. Nos. 3,883,142 and 4,093,235 deal particularly with the tourist games.

SUMMARY OF THE INVENTION

The main object of the invention is to provide a game apparatus which overcomes the disadvantages of the prior art apparatuses regarding tourism.

The play begins with the supposition that the area it deals with (such as New York City or the State of Arizona, for example) is unknown for the players while each of them is proposed to play a role of a tourist entering said area for the pleasure purposes. During the course of playing the game the various necessary information concerning the visited area is disclosed. All the players become aware about geography, historical, social, entertainment and amusement interests in the area, learn how and where to make shopping, in which hotel to stay, and what restaurant to choose; they are also informed about the geographical locations of the above existing attractions and services on the corresponding map. The players have a feeling of visiting the places as they also required to travel from one location to another using the existing means for transportation available in New York City or Arizona. At the end of the game all the participants are required to ask the questions dealing with the information concerning Arizona or New York City previously disclosed; correct answers to these questions, in accordance with the educational purpose of the game, help to select the first winner. The second winner is selected by chance. Also the two embodiments presently disclosed deal with the geographical localities of the State of Arizona and the City of New York, the invention is intended to be applicable to every state, site, region or city in the United States of America or in the world.

Being instructive and educational, the game has broad marketing possibilities because, as follows below from the disclosure of the preferred embodiment for a kit container, it can be also played in the airplanes during flight, on trains, cruises, vacation journeys. The above marketing possibilities matching the object of the game intended to promote tourism, can also reduce the cost of the manufacture of the game.

Briefly, in accordance with the present invention there is provided a game board comprising an outlined geographical map displaying a plurality of various indicia characterising the existing geographical features along with the existing locations of the selective attractions usually visited by tourists in the area the game deals with. There is a plurality of cards distributed between the players containing along with the appropriate instructions pertinent information regarding the tourist attractions and services given in the corresponding locations of the area. Each player is provided with the token being moveable for travel. In addition, the equipment of the game may include one or more actual maps or plans of the corresponding means for transportation available in the visited area, such as, for example, the New York City's subway and bus maps which the players may consult during the course of playing the game. Each player has to perform an individual travel within the area between the centers of concentration of the attractions and services. Consequently, the itineraries of the travels during the play do not coincide, while all the players using if necessary, the different means for transportation available in the area, move from the different parts of the game board to a finish which is the common final point for all players.

BRIEF DESCRIPTION OF THE DRAWINGS

FIG. 5 is a table of itineraries divided to the stations bearing the titles as it is shown in FIG. 1 and FIG. 2;

FIG. 6 is a table of itineraries divided to the stations bearing the titles as it is shown in FIG. 3 and FIG. 4;

FIG. 12.*b* is an inside view of a kit container shown in FIG. 12.*a*.

FIG. 12.*c* represents the front and rear views of a Bank pocket which is a part of FIG. 12.*b* and FIG. 12.*d;*

FIG. 12.*d* is a perspective view of an open kit container shown in FIG. 12(*a–b*);

FIG. 12(*e–f*) are the illustrations of the two still another views of an open kit container, respectively, top view (FIG. 12*e*) and side view (FIG. 12*f*);

DESCRIPTION OF THE PREFERRED EMBODIMENTS

Figure 1:
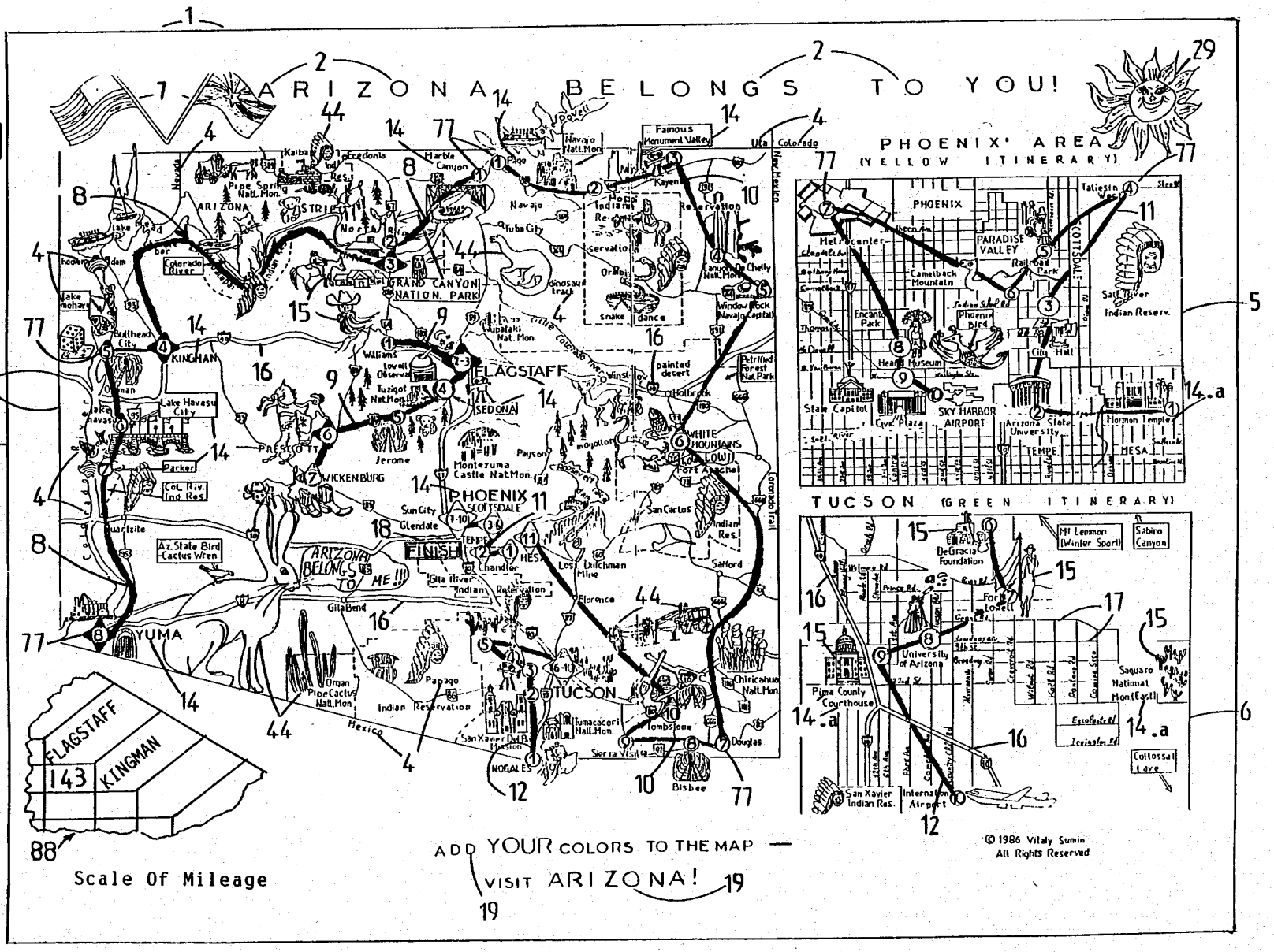
FIG. 1 is a plan view of one form of the board for the game dealing with the embodiment designated to the market under the name "Arizona Belongs To You!"
Figure 2:
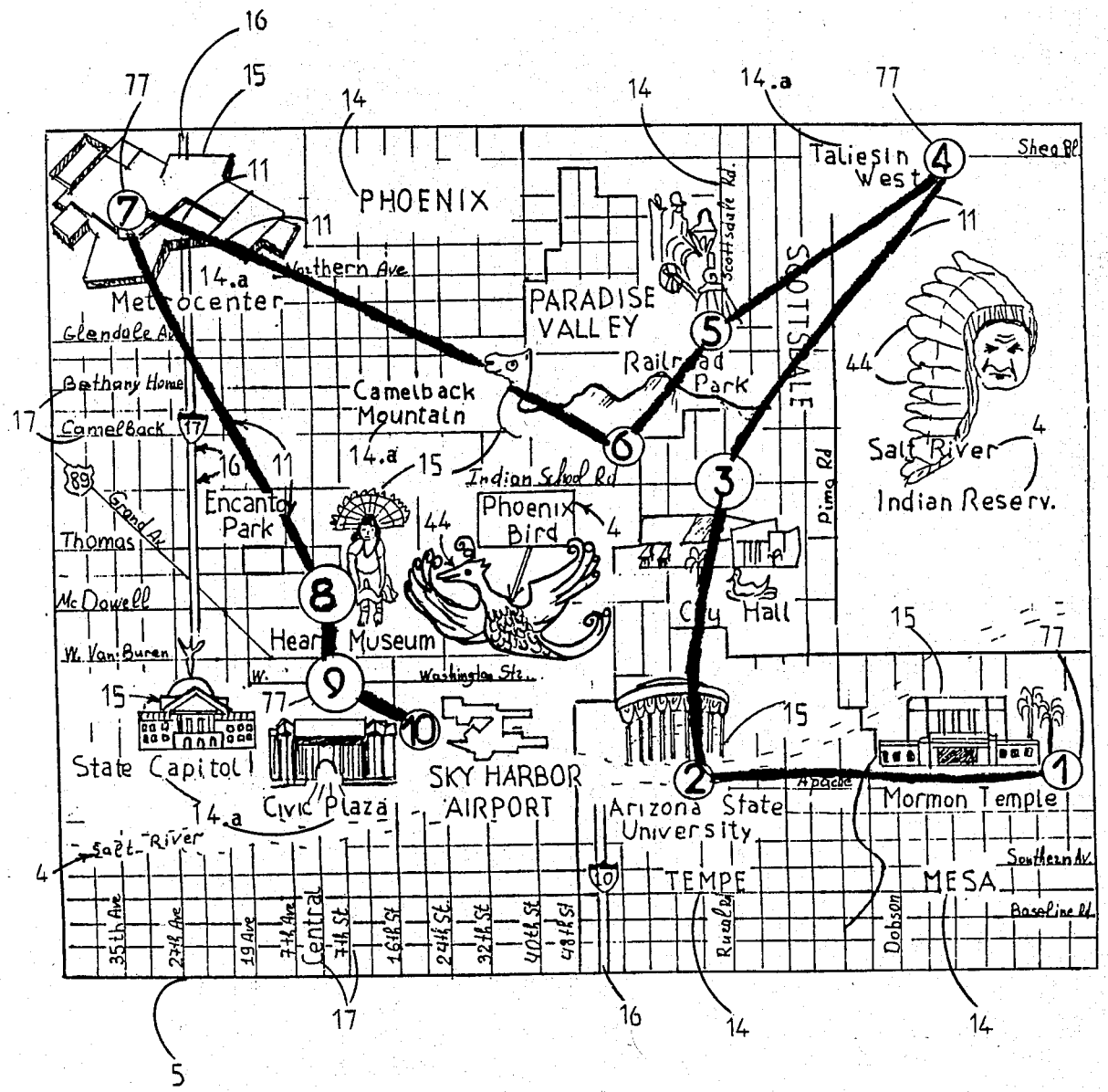
FIG. 2 is an enlargement of a portion of FIG. 1; this portion illustrates the necessary details forming part of the game.

Referring to FIG. 1, there is indicated at 1 a board as a whole, comprising the particular embodiment of the game dealing with the state of Arizona as disclosed in drawings and designated to the market under the name "Arizona Belongs To You!" as indicated at 2. An outline of a map of Arizona 3 wherein the lakes, rivers, mountains, highways, routes and other corresponding indicia are marked, is provided in the central and left area of the board 1. A detailed map of the area of the city of Phoenix 5 (located in lower central part of the map 3) is represented on the upper right corner of the board 1. A detailed map of the city of Tucson (located in the lower right part of the map 3) is represented on the lower right corner of the board 1. The flag of the United States and the flag of the State of Arizona 7 are represented on the upper left corner of the board 1. FIG. 2 showing the detailed map of the area of the city of Phoenix, represented in smaller scale in FIG. 1 at 5, illustrates the necessary details forming part of the game.

Figure 3:
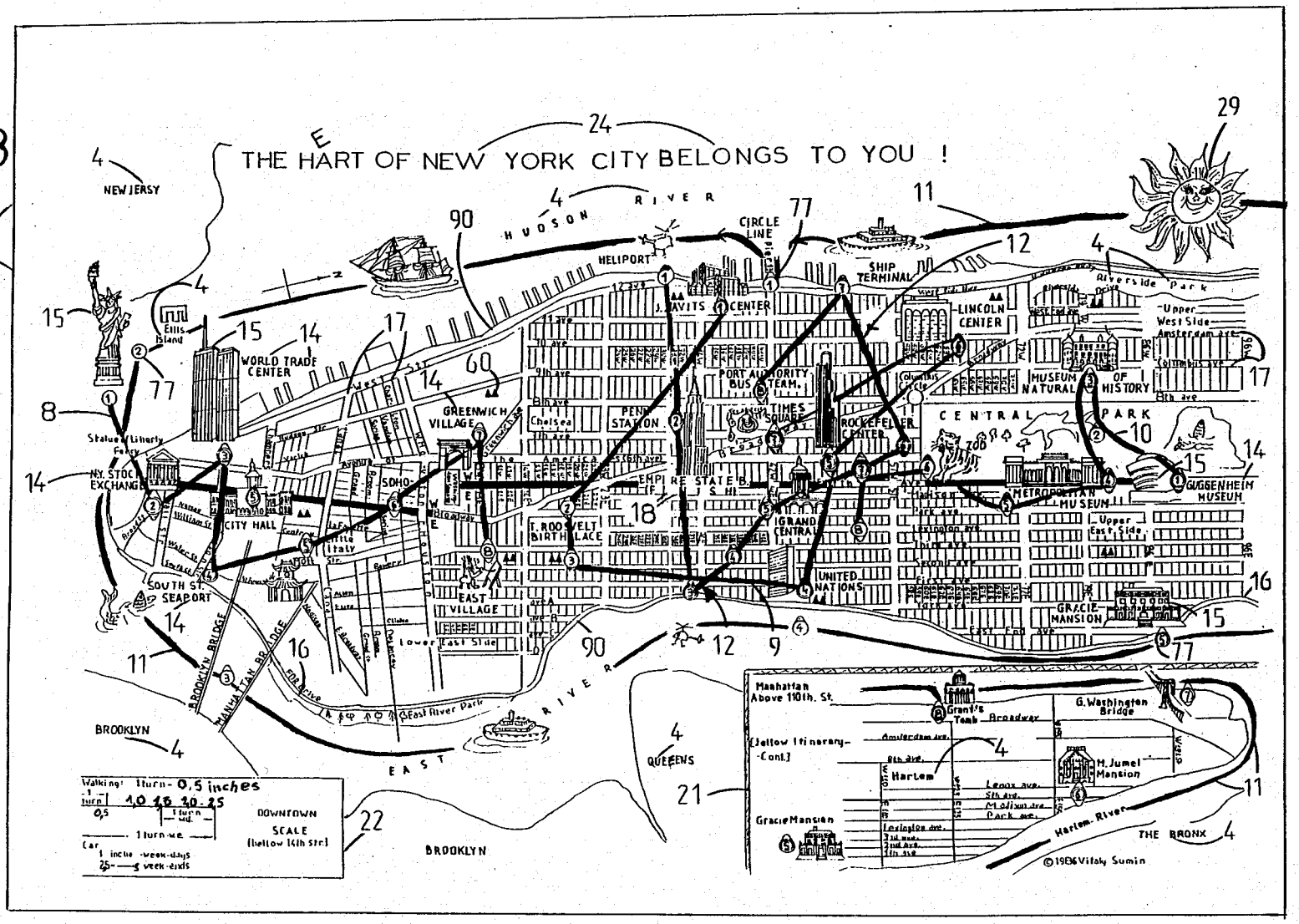
FIG. 3 is a plan view of one form of the board for a game dealing with the embodiment designated to the market under the name "The Heart of New York City Belongs To You!"
Figure 4:
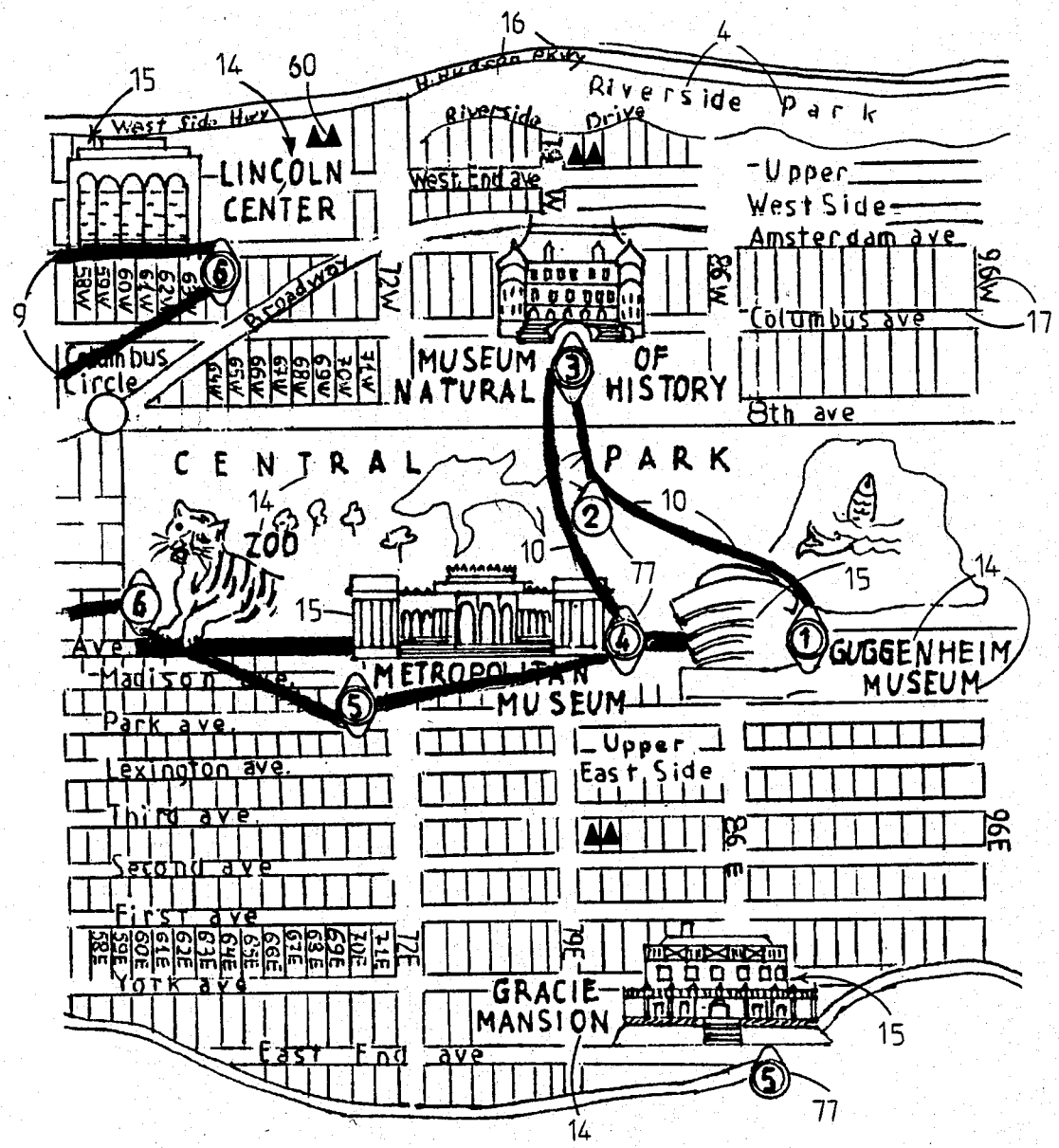
FIG. 4 is an enlargement of a portion of FIG. 3; this portion illustrates the necessary details forming part of the game.

FIG. 3 illustrates another particular embodiment of the game dealing with the city of New York as disclosed in drawings and designated to the market under the name "The Heart of New York City Belongs To You!" as indicated at 24. An outline of a map of Manhattan below 96th street 90 showing the main features of this part of New York City and its surroundings, occupies the most of the space of the board 70. On the map 90 the selective car rental services generally designated 60 are displayed. An outline of a map of Manhattan above 110th street 21 is located in the lower right corner of the board 70. FIG. 4 showing the detailed map of the area of Manhattan above 57th street, represented in smaller scale in FIG. 3, illustrates the necessary details forming part of the game.

A downtown scale 22 located in the lower left corner of the board 70 (FIG. 3) and the scale of mileage 88 located in the lower left corner of the board 1 (FIG. 1) bear the indicia serving the player's movement according to the rules of the game as disclosed below. The thick distinctive lines 8, 9, 10, 11, 12 which cross the maps 3, 5, 6 (FIGS. 1, 2) and 90 (FIGS. 3, 4) in different directions, represent the itineraries of red, orange, violet, yellow and green colors serving the paths of travel for the players. Circular markers with included different numbers are displayed by itineraries 8–12; these markers having sometimes one or more triangles adjusted to the outside parts of the circles represent the stations 77 or stopping points to the players. The titles 4 indicate the important geographical features, political subdivisions and other such important characteristics in relation to the state of Arizona or New York City; for example, Colorado River, Lake Powell, State of Utah, Papago Indian Reservation (FIG. 1) or Hudson River, Ellis Island, Brooklin, Harlem (FIGS. 3, 4). The titles 14 (FIGS. 1–4) and 14.*a* (FIG. 2 only) are associated with the stations 77 and indicate the geographical locations of the important attractions and services related to the existing historical, geographical, cultural, entertainment, shopping and other interests in New York and Arizona; for example, Taliesin West, Arizona State University, Metrocenter (FIG. 2); World Trade Center, Guggenheim Museum, Gracie Mansion (FIGS. 3, 4). The designs 15 intended to better familarize the players with the place, display sometimes in comic manner, a pictoral information associated in most cases with the corresponding titles 14 and 14.*a;* for example, the title 14.*a* (FIG. 2) which reads "Camelback Mountain", indicating one of the most famous landmarks characterizing the city of Phoenix (corresponding in reality to the mountain having the shapes resembling to the back of camel) is associated with the comic design of camel 15 clearly visible in the central part of FIG. 2. The design of the World Trade Center 15 being one of the worldwide known landmarks of New York City accompanied by the corresponding title 14 is shown in FIG. 3. The other pictoral information 44 which is not associated directly with the stations 77 provide the players with more information about Arizona or New York (corresponding in some cases to titles 4).

Highways 16 as well as the streets of the cities (Phoenix, Tucson, New York) 17 accompanied in most cases by the corresponding indicia, are shown in FIGS. 1–4. Finish 18, representing the final stopping point for all players, is located in the lower central part of the map of Arizona 3 (FIG. 1) where it is associated with the Sky Harbor Airport, and in the central part of the board 70 where it is associated with the Empire State Building (FIG. 3). Each of the itinerarie 8, 9, 10, 11, 12 is dedicated to a different player; during the course of playing the game, each player has to perform a travel from the beginning of his/her itinerary associated with the station 77 having number 1 within the circular marker, to the last station of his/her itinerary and, finally to finish 18.

The inscription 19 located at the bottom of the central part of FIG. 1, which reads "Add Your Color To The Map! Visit Arizona!" can be applied to the embodiment dealing with the City of New York (by changing the name of the State to the name of the city) or to any other embodiment of the game; it manifests one of the educational purposes of the game intended to provide the youngsters with means for coloring designs 15 and 44 and therefore acquaint them with the place any particular embodiment of the game deals with.

FIG. 5 and FIG. 6 represent respectively the tables of itineraries regarding the State of Arizona and the City of New York showing the structure of the choice of the stations 77.*a* (corresponding to the stations 77 in FIGS. 1–4) displayed by the itineraries of the different colors, 8.*a* (red), 9.*a* (orange), 10.*a* (violet), 11.*a* (yellow), 12.*a* (green) corresponding respectively to the itineraries 8, 9, 10, 11, 12 in FIGS. 1–4; the geographical distributions of these itineraries are indicated in FIGS. 5 and 6 by appropriate markings 20. The titles 14 disclosed in FIGS. 5 and 6 and the titles 14.*a* (disclosed in FIG. 5 only) are related to the concentration of the most visited tourist attractions of the state of Arizona and the city of New York matched with the existing services and selected therefore for the game purpose as it is shown also geographically in FIGS. 1–4.

Each title 14 corresponds to at least one playing card which contains an information pertaining to one of the definite stations 77. Each of the subtitles 14.*a* represents one playing card which deals with the selective attraction and/or service located in the vicinities of any of the definite stations related to the titles 14. For example, station #1 of the violet itinerary 10 (FIG. 5) bearing title 14 "PAGE" indicates the city (where the services are located) serving the base for the tourists going to the area of the Lake Powell (subtitle 14.*a*) with which the corresponding playing card deals in particular. The location of the city Page on the upper central part of the border of the map 3 (FIG. 1) coincides geographically with the circular marker indicating the station 77 bearing number 1 of the violet itinerary 10.

FIG. 2 representing an enlarged portion 5 of the map 3 (FIG. 1), deals directly with the subtitles 14.*a*. For example, station #7 of yellow itinerary 11, located in the upper left corner of FIG. 2, bears the title 14 "PHOENIX" and the subtitle 14.*a* which reads "Metrocenter" (one of the largest shopping centers in the world) as it is follows from the appropriate disclosure of FIG. 5. The number of the playing cards corresponding respectively to each station in FIG. 5 and FIG. 6, is indicated by markings 99. Consequently, the circular markers indicating the stations 77 in FIG. 1 and FIG. 2 (Arizona's embodiment of the invention) are smaller when they indicate only one associated playing card 99, and are bigger in size when markings 99 denote 2 or 3 playing cards. As far as the embodiment of the present invention dealing with New York City is concerned, the circular markers indicating the stations 77 in FIG. 3 and FIG. 4 include one, two or three circles corresponding respectively to one, two or three cards as it is shown by markings 99 in FIG. 6.

Figure 8:
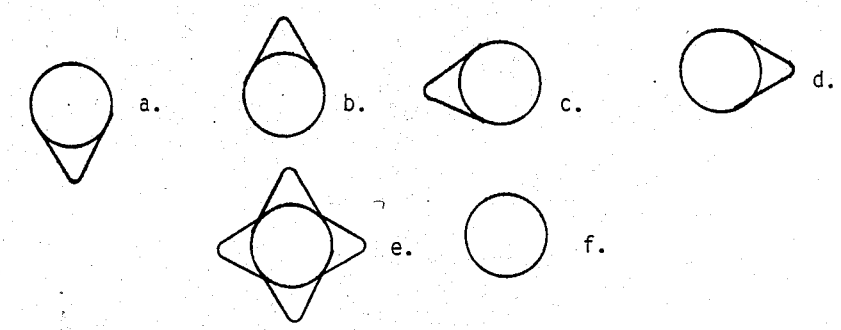
FIG. 8 shows the codes displayed in FIG. 1; these codes illustrate the existing means for transportation.
Figure 9:
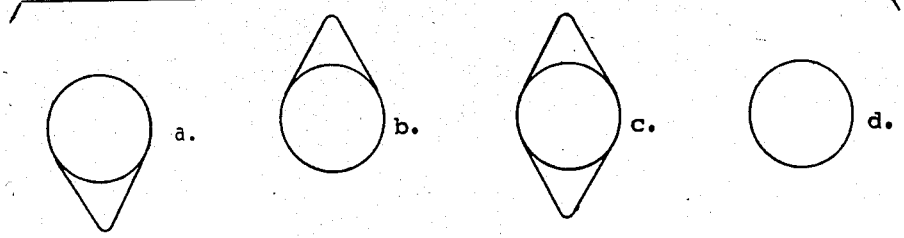
FIG. 9 shows the codes displayed in FIGS. 3, 4; these codes illustrate the existing means for public transportation.
Figure 10A:
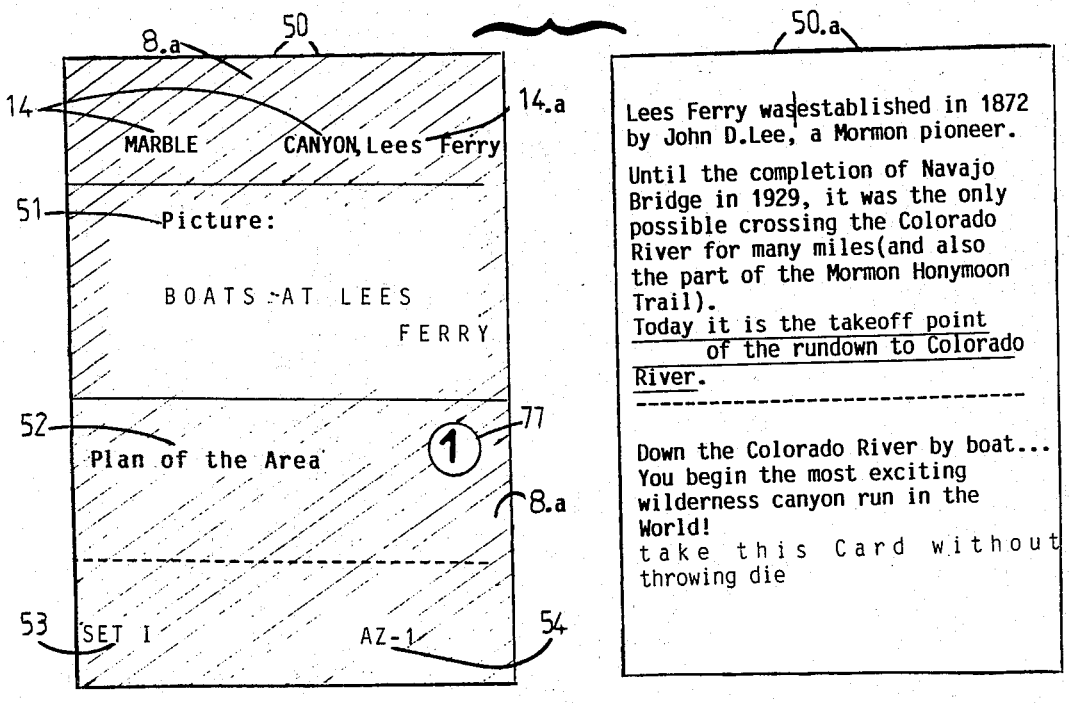
FIG. 10(*a–e*) represent the face and reverse sides of the various playing cards in relation to the embodiment of the game disclosed in FIGS. 1, 2, 5; however, the structure of the composition of these cards can be the same for other embodiments of the game.
Figure 10B:
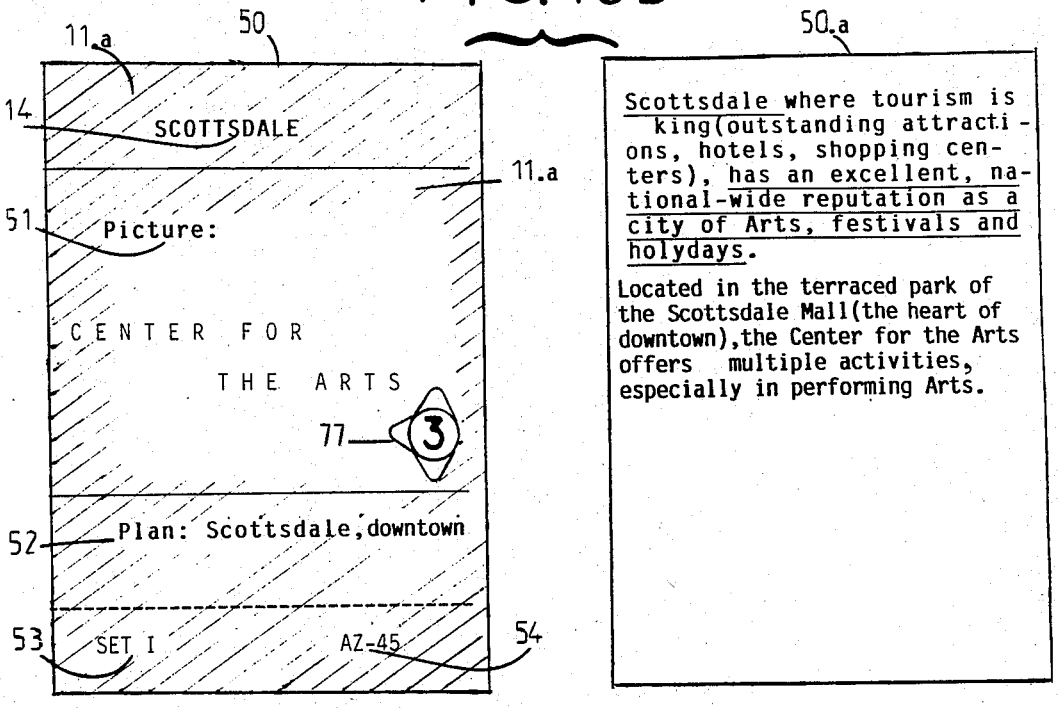
Figure 10C:
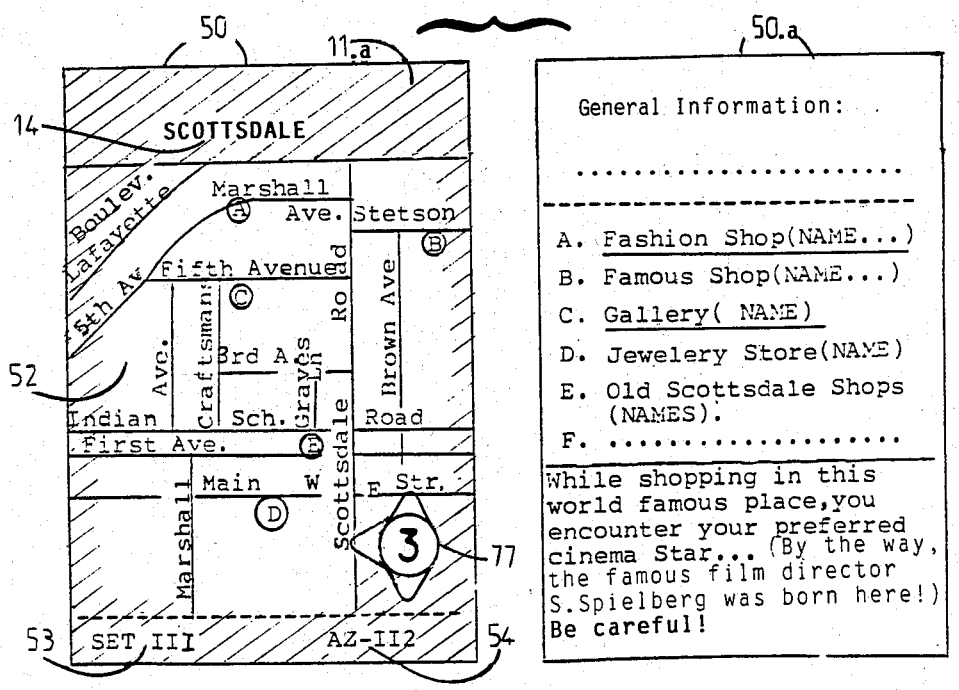
Figure 10D:
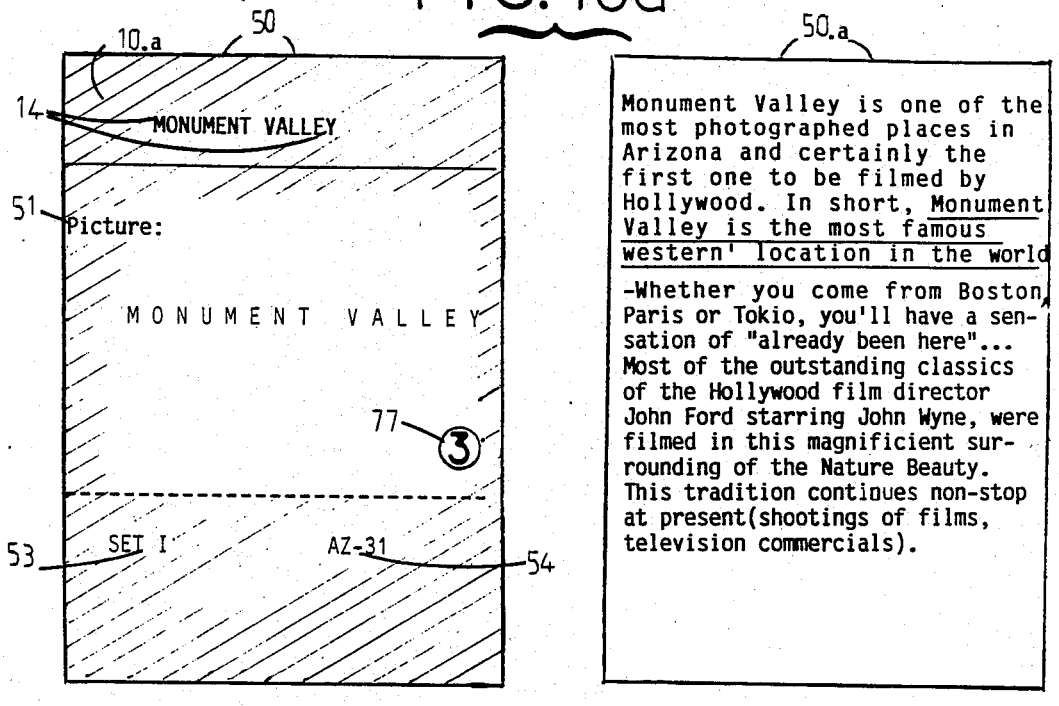
Figure 10E:
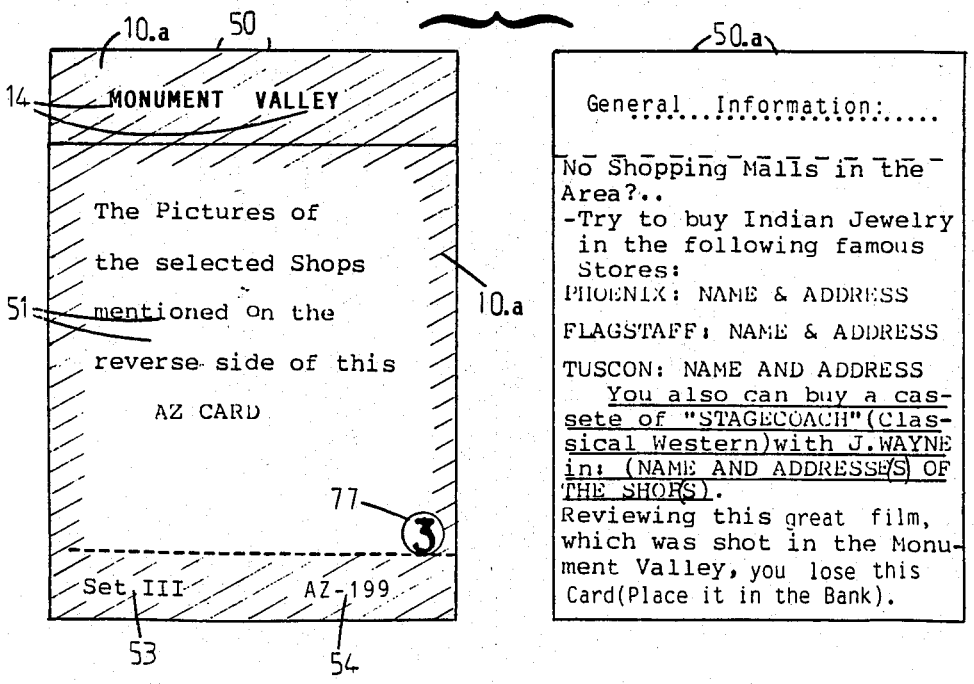

The codes disclosed in FIG. 8 and FIG. 9 reflect the conditions of the actual availability of the different means for transportation in the geographical locations displayed in the corresponding maps 3 and 90 where they are associated with the stations 77. Consequently, in FIG. 8 which deals with the embodiment of Arizona, a triangle placed at the bottom of the circle, "a", indicates the existence of the car rental services; a triangle placed in the top of the circle, "b", indicates the existance of the airport which can be used for travel; signs "c" and "d" indicate respectively bus and train services; sign "e" shows the availability of the all above mentioned means for transportation, and sign "f" reads that no one of the above means is available. In FIG. 9 concerning the embodiment of New York City, the displayed codes indicate respectively: subway ("a"); bus ("b"); bus and subway ("c"); non of the above ("d").

FIG. 10(*a–e*) illustrate the method of composition of playing cards related to the embodiment of Arizona which can be used for the composition of the playing cards for the other embodiments of the game. Each playing card corresponds to one of the definite stations 77 belonging to one of the itineraries 8, 9, 10, 11 or 12 as it is disclosed structurally in FIG. 5 and shown geographically in FIGS. 1 and 2. For, example, FIG. 10.*a* shows the face 50 and reverse 50.*a* sides of the playing card associated with the station 77 having number 1 of red itinerary 8 and located in the upper central part of the map 3; this station has the title 14 disclosed as "MARBLE CANYON" (a small site where some services are located) and subtitle 14.*a* which reads "Lees Ferry". The detailed geographical plan of the area related to Marble Canyon and included Lees Ferry is represented in 52; a picture bearing a visual information characterizing 14.*a* (Lees Ferry) is disclosed in 51. For better identification all cards associated with the stations 77 displayed in FIGS. 1, 2 by the itineraries 8, 9, 10, 11, 12 are color coded correspondingly to the color of the itinerary each of the cards belongs. Consequently, the markings 8.*a*, 9.*a*, 10.*a*, 11.*a*, 12.*a* related to the hatched portions of 50 identify respectively the parts colored in red, orange, violet, yellow and green. For example, the hatched portion marked 8.*a* of the playing card shown in FIG. 10.*a*, belonging to the itinerary of red color, is coded by red color. All playing cards also reproduce the symbol of the station 77 with which each card is associated. The informational portions of the playing cards are represented on 50.*a*. Some playing cards also provide in 50.*a* (after the informational portion) certain instructions for the purpose of rewarding or penalizing players (FIG. 10.*a*, 10.*e*).

Each of the playing cards bears the mark 53 indicating the set to which the card belongs. For example, SET I (FIG. 10.*a*, 10.*b*, 10.*d*), SET III (FIG. 10.*c*, 10.*e*). As it is mentioned hereinabove, the disclosed embodiment of the present tourist game is designed to guide and educate the players about geography, historical, social, entertainment and amusement interests in combination with the shopping, restaurants and hotel accomodation available in the place any particular embodiment of the game deals with. Consequently, the playing cards containing the information regarding the above mentioned features are divided on different sets. Each set represents a particular combination of the playing cards in accordance with the following principle:

SET I (basic set)—Museum Historic Places, National Monuments, Exciting Attractions;

Optional Sets:

SET II—Accomodation and transportation services;

SET III: Shopping;

SET IV: Restaurants and entertainment.

It is understood that the themes and the total number of optional sets can be augmented or reduced as far as the attractions and/or services of any particular region are concerned. For example, some optional sets can be devoted exclusively to: "Sport Facilities In Arizona" or "Toy Shops of New York City" or "Disneyland" or "Theaters of London", "Exciting Places Of Hollywood", "The Corrida In Spain", et cetera. According to this principle, even basic set I can be divided to the separate sets; for example: "The Museums of New York City", "The Selected US National Monuments", "Animal and Botanical World of Arizona", "The Cathedrals of France", "The Archaeological Excavations in Italy", etc. As far as the disclosed embodiments of the game regarding Arizona and New York are concerned, each set contains 70 playing cards as shown in FIGS. 5 and 6. In this case, each game (dealing with one of the embodiments) comprising 4 sets, contains 280 playing cards.

Each playing card bears a serial code 54 consisting from two parts: lettered and numerical; lettered part contains the abbreviation of the name of the area any particular embodiment of the game deals with, for example AZ in the case of the state of Arizona; the numerical component represents the number of the playing card. For example, the serial code 54 of the playing card shown in FIG. 10.*a* is: AZ-1; the serial code 54 of the playing card shown in FIG. 10.*c* is AZ-112.

FIG. 10.*c* and 10.*e* show the method of the composition of the playing cards for the optional set III: Shopping; the principle of such composition is the same for all optional sets described hereinabove. For example, on the face side 50 of the card AZ-112 shown in FIG. 10.*c* is given the plan 52 of the area surrounding the location of the station 77 bearing number 3 of Yellow Itinerary 11; this station is clearly visible in FIG. 2. The plan 52 in FIG. 10.*c* displays the locations of the selected shopping points. The reverse side 50.*a* of the playing card AZ-112 identifies the shopping points shown in 52 and also provide an information regarding the place. Some playing cards of the optional sets can show in 50 only a visual information 51 as disclosed in FIG. 10.*e*; some can combine 51 and 52 (along with 53, 54, 14, 14.*a*) as disclosed for example, in FIGS. 10*a, b, d* dealing with the composition of the playing cards for basic set I.

Figure 11A:
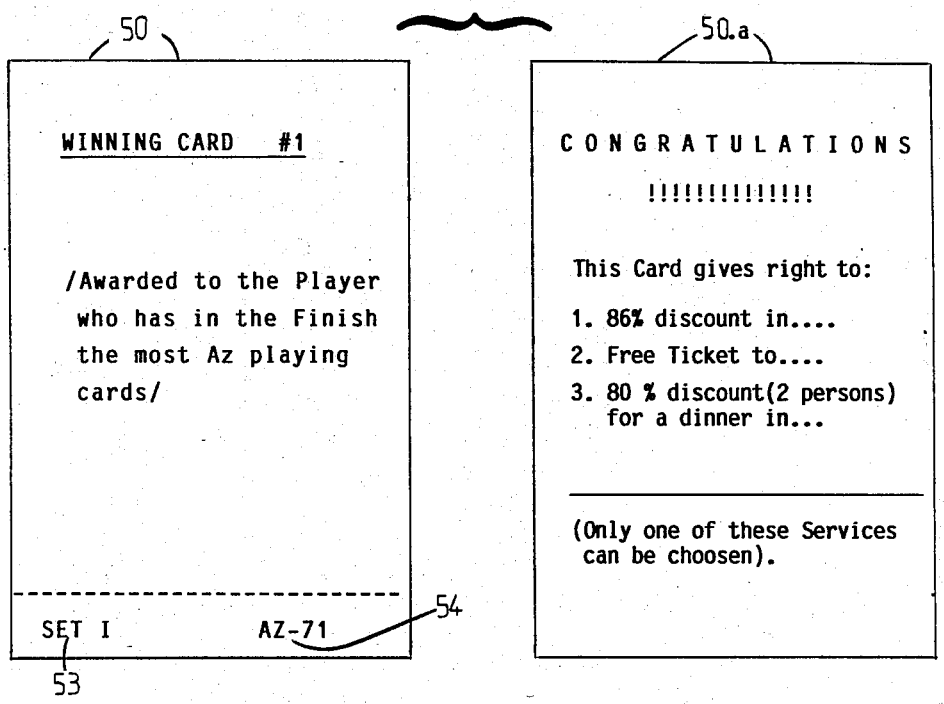
FIG. 11(*a–b*) represent the face and reverse sides of the winning cards being awarded to the winner of the game related to the embodiment of the game disclosed in FIGS. 1, 2, 5; the method of the composition of these cards can be the same for other embodiments of the game.
Figure 11B:
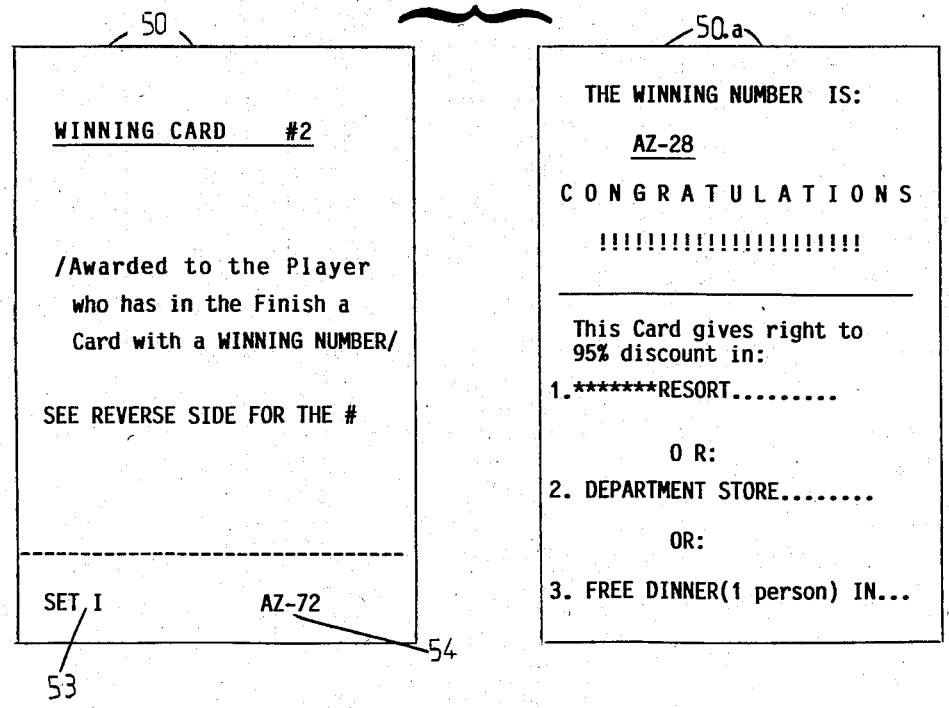

The two winning cards characterising the embodiment of the game related to the State of Arizona, are shown in FIGS. 11.*a* and 11.*b*. As it is follows from the descriptions on 50, these winning cards are awarded respectively to: a player who arrives in the Finish 18 accumulating the most playing cards (winning card #1); a player who has in the Finish 18 a playing card with a winning number (winning card #2) which is a serial code 54; this secret number is revealed only in the end of the game. The discounts proposed in 50.*a* can be: (1) only for the purpose of amusement which does not reflects any real situation; (2) real discounts. In brief, the content given in the sides 50.*a* is illustrative only and the other ideas intended to surprise the players can be adopted. For example, some winning cards can contain information regarding the dates of some off-off Broadway shows wherein the conditions of entry are free anyway; some winning cards can instruct the players about the best hour and place where they can fish or see a sunset in Arizona (including the recomendation regarding the best camera position for taking pictures, fishing conditions, etc).

Figure 12A:
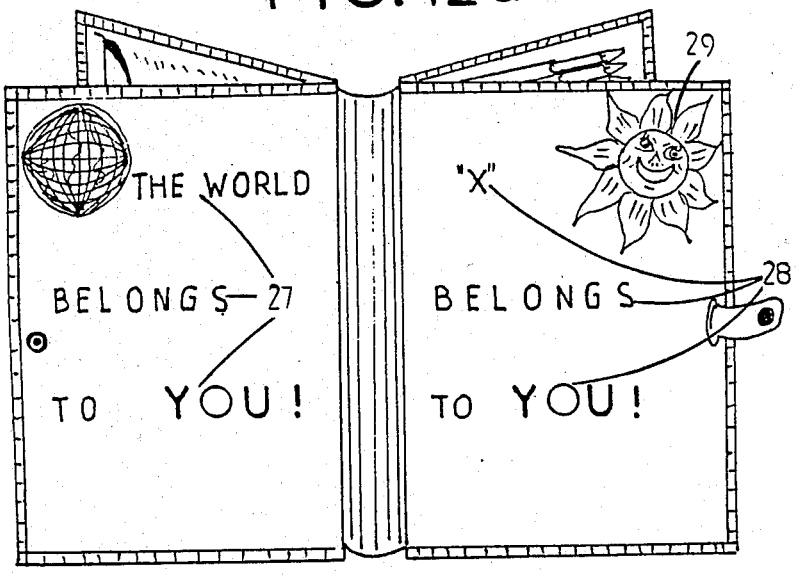
FIG. 12.*a* is an outside view of an open kit container designed to be applicable for different embodiments of the game.
Figure 12B:
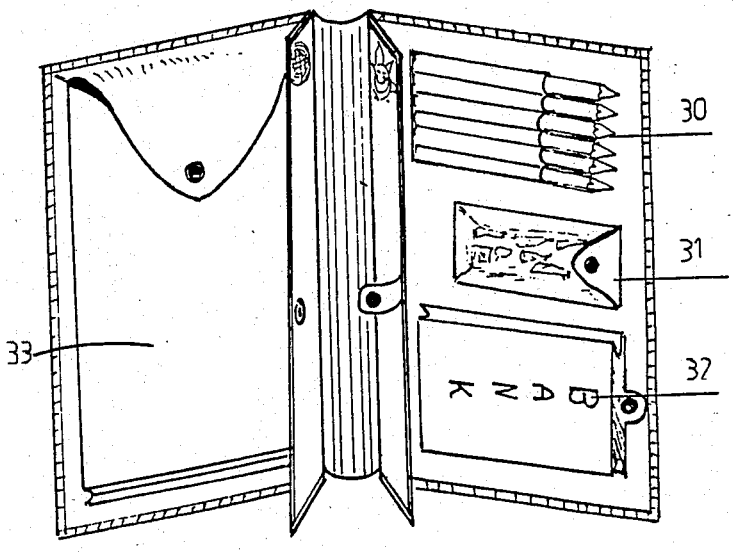
Figure 12C:
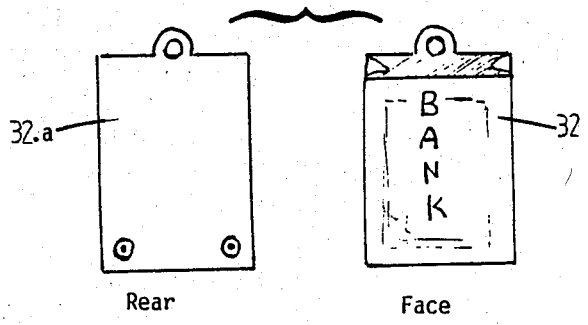
Figure 12D:
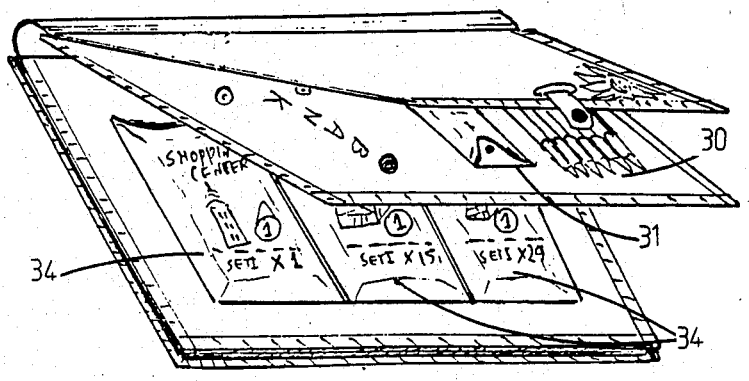
Figure 12F:
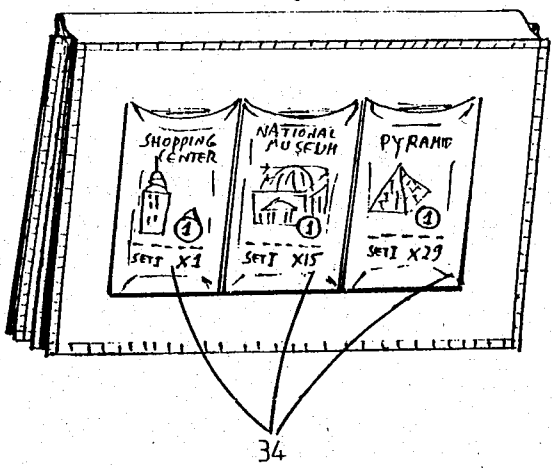
Figure 12E:
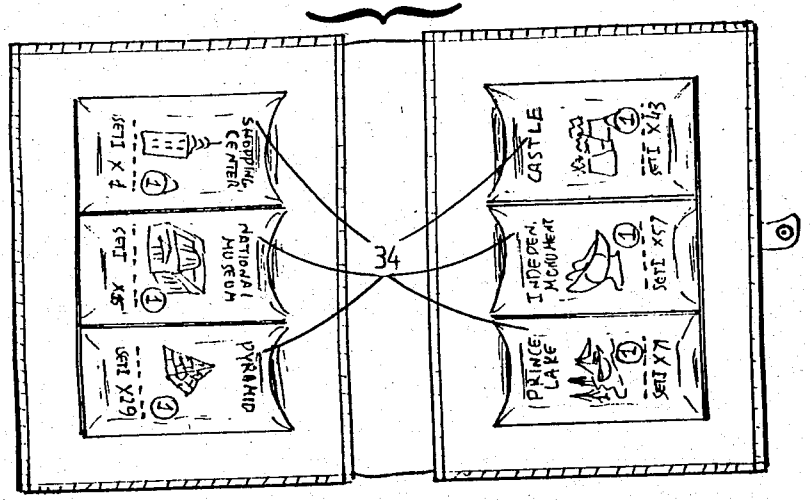
Figure 14:
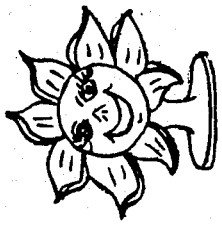
FIG. 14 is a view of one of the tokens composing a set being moveable for travel during the course of playing the game.
Figure 13:
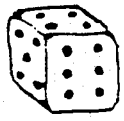
FIG. 13 illustrates a die used by the players during the course of playing the game.

FIGS. 12(*a–f*) illustrate the different views of a kit container for the present game designed for use also in the conditions of a travel. FIG. 12.*f* demonstrates for example, the kit container arranged for the purpose to serve the two or three players inside an airplane; in this case, assuming that a position of the kit arranged on the rear of the back of the chair of the prior row is stable, a board (FIGS. 1 or 3) and other corresponding items can be placed right below the kit in the adjusted table generally served the passengers for dining. Inscription "X Belongs To You!" 28 indicates a name to be used in the market in conjunction to any particular embodiment of the game; for example, in accordance with the present disclosure characterizing the two particular embodiments of the game, "Arizona Belongs To You!" 2 (FIG. 1) and "The Heart Of New York City Belongs To You!" 24 (FIG. 3). Inscription 27 "The World Belongs To You!" indicates generally the name to be used in the market characterizing all possible embodiments of the game; for example, "Arizona Belongs To You!", "Washington, D.C. Belongs To You!", "London Belongs To You!", "Tokio Belongs To You!", etc. Sign 29 can be identified as a comic symbol of a sun; and because a sun is one of the most essential elements associated with world wide tourism, sign 29 is represented also in the game boards of the two present disclosures (FIGS. 1, 3) and the design of a token in FIG. 14. In FIG. 12.*b* mark 30 identifies the combination of color pencils for coloring designs 15 and 44 (FIGS. 1–4); the pocket 31 serves for keeping a die (FIG. 13) and a set of tokens, each of them (FIG. 14) being assigned to a different player and being color coded in red, orange, violet, yellow and green in accordance with the colors of the itineraries 8, 9, 10, 11 and 12 displayed in FIGS. 1–4 as disclosed above. A pocket having an inscription "Bank" 32 represented in FIGS. 12(*b–c*) serves for collecting the playing cards which are missed by the players during the course of playing the game. The playing cards in the transparent pockets 34 are visible respectively in FIGS. 12(*d–f*). A pocket 33 is designated for containing a board (FIGS. 1 or 3), table of itinerary (FIGS. 5 or 6), winning cards (FIGS. 11*a–b*) and other such corresponding material depending on the embodiment of the game, for example, an actual subway and/or bus map of an existing municipality, etc. FIG. 13 shows a simple die particularly convenient for using in the conditions of travelling; however, any type of number chance indicating means can be used and serve the purpose.

Figure 7:
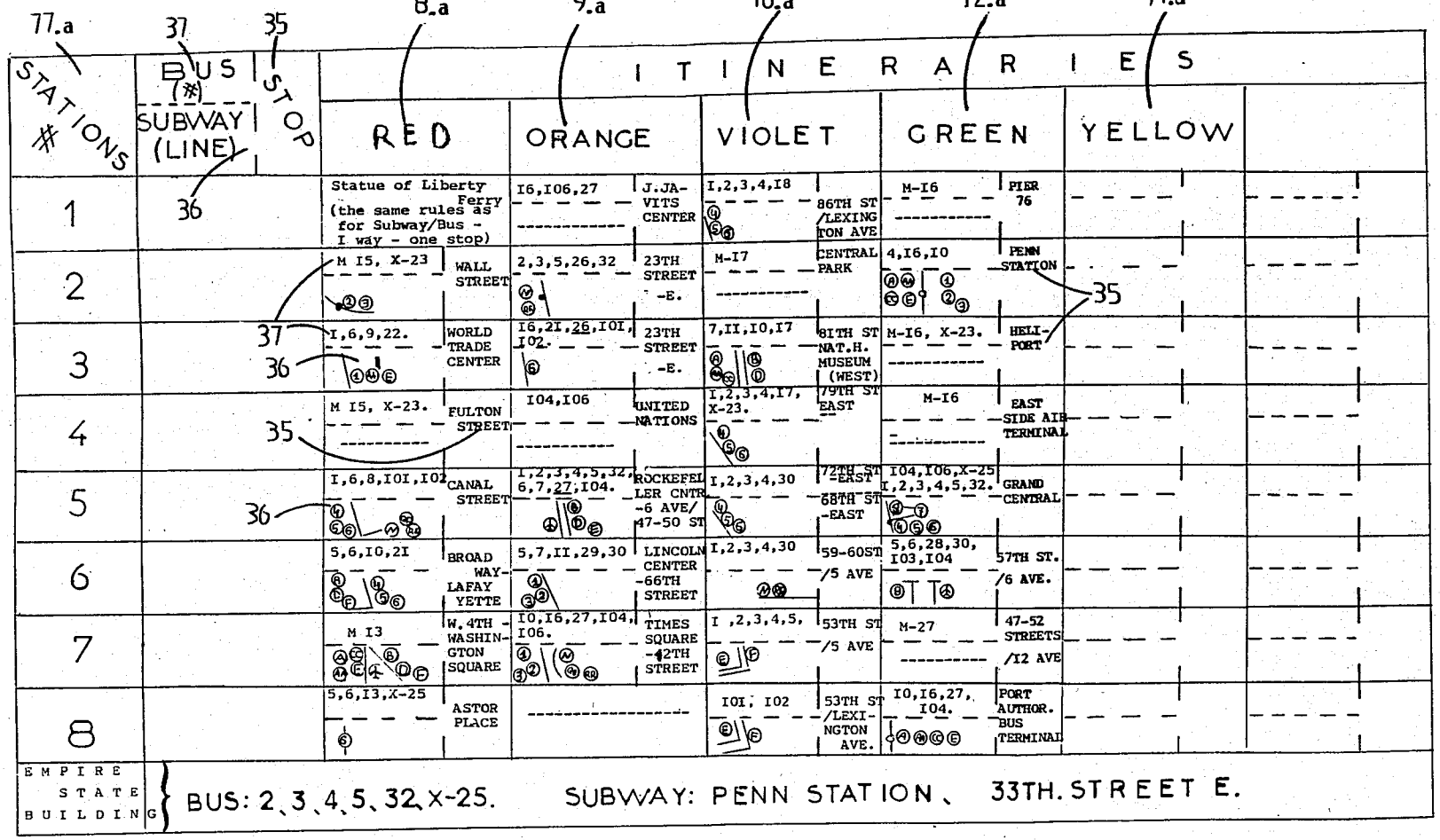
FIG. 7 is a Transit Table bearing the indicia characterising the structure of the existing public transportation, such as the bus and subway systems, in relation to the embodiment of the game disclosed in FIGS. 3, 4, 6.

FIG. 7 represents a Transit Table bearing the indicia characterizing the actual structure of the courses of the different subway lines and bus routes in the City of New York indicating the bus 37 and subway 36 stops 35 available in the vicinities of the stations 77 displayed by the itineraries 8, 9, 10, 11, 12 in FIGS. 3–4. Also the indicia provided by the Transit Table reflect the numerical and colored indicia shown by the corresponding maps of the actual subway and bus systems of a municipality of New York City, the same principle of the composition of the Table can be applied for any of the combinations of the existing means for public transportation in any other city or region of the United States and the world. A player who is located, for example, in station 77 bearing number 1 of the Violet Itinerary 10 (FIG. 4) associated with Guggenheim Museum (as indicated by title 14 and design 15) and desires to reach the station #6 of the Orange Itinerary 9, associated with Lincoln Center (indicated by 14 and 15), may consult the Table (FIG. 7) and make a choice: to take a bus #1,2,3 or 4 at 86th street, to stop at Fifth Avenue/60th Street and then continue by walking or taking bus #30 until Lincoln Center according to the game rules described below. If the player desires for example, to arrive from the station associated with Guggenheim Museum to East Village (station #8 of Red Itinerary 8, FIG. 3), the better solution will be to take subway #6, etc. It is understood that for choosing the most economical transit possibilities, the player can use along with the Table, a(the) map(s) of the appropriate system(s) of public transportation.

PLAYING THE GAME

The game can be played by two to 5 players. There are two winners: a player who arrives in the Finish 18 accumulating the most playing cards; (b) a player who has in the Finish 18 a playing card with a winning number; as it is described in FIGS. 11*a–b*. Before the play is started, the kit container (FIGS. 12*a–f*) is open and the playing cards clearly visible in the transparent pockets 34 in FIGS. 12*d–f* are checked. The playing cards of each pocket 34 must be of the same itinerary and composed in increasing numerical order, beginning from station number 1 (top of the deck) to the last station of each itinerary according to the order shown in FIGS. 5 and 6. Each player is assigned a token (FIG. 14) corresponding to one of the itineraries 8–12 of the same color and places the token on the start of his/her itinerary corresponding to the station 77 having number 1. Then, in turn, each player picks the top playing card from the deck of his/her itinerary and checks (replace, if necessary) his/her token's position on the playing board (FIGS. 1, 3) according to the station 77 number indicated in 50 on each playing card (FIGS. 10*a–e*) as well as in the game board. Then each player reads aloud: (a) the name and the place his/her playing card deals with—showing to the other players the corresponding picture 51 and identifying this place on the game board; (b) informational portion (which can also contain the instructions) given in 50.*a* of his/her playing card.All the players are advised to memorize maximum details and information as, later the chance of each of them to be a winner may depend on his/her familiarity with these details and information.

Next (if not instructed otherwise in 50.a), each player rolls the die (FIG. 13). Only number 6 on die gives right to a playing card (one card). The player who is not succesful in obtaining "6", may roll the die another two times (same turn). If again he/she is not successful in obtaining "6" but has an even number twice (only the last two rolls count)—he/she gets the playing card. Therefore, only 3 rolls per one turn/one playing card are permitted. If the player misses the playing card, it is placed in the Bank 32 (FIGS. 12*b–c*). The first player who reaches Finish (or will be permitted to collect a playing card from Bank 32 during the course of playing the game according to his/her card instruction given in 50.*a*) will get this missed playing card.

Finally, all the players reach respectively the last stations 77 of their itineraries 8–12 displayed on the board (FIGS. 1 or 3); now each of them asks his/her opponent from the right (clockwise order) questions formulating them from the underlined section of the informational portion provided on the reverse side 50.*a* (FIGS. 10*a–e*) of each of the playing cards the player has collected. Assuming that the content of the informational portions of all playing cards has been already disclosed to all players during the course of playing the game, as stated hereinabove, the educational qualities of the game become evident. Each correct answer corresponds to one point. The player having the most points is permitted to arrive to Finish 18 first and receive all missed playing cards from the bank 32.

The rules described above do not require the players leave the fixed itineraries 8–12 and can be applied to any of the embodiments of the game played in the conditions of a travel. The following adjustments to the above rules permitting to leave the fixed itineraries are applied to the game played at home conditions or in any other convenient place. These adjustments matched with the educational purpose of the game, provide an opportunity for each player to be familiar with the means for transportation of a city or a region each particular embodiment of the game deals with, and to choose one or another of those means for player's convenience while the latter explores the tourist attractions of a city/region.

It is understood, according to the previous disclosure, that any of the missed playing cards can be a card with a winning number giving right to a winning card #2 (FIG. 11.*b*). Therefore, the rules of the adjustment state that if one of the players misses a playing card, each of the other players, in order, can use his/her turn (one turn) for trying to collect this card. This player simply place his/her token (FIG. 14) to a station 77 with which a missed playing card is associated, and immediately rolls the die according to the principle described above (3 rolls maximum). If the player doesn't get a missed playing card, he/she returns the token to the appropriate station of his/her itinerary and waits for another turn. However, if the player does get a missed playing card, he or she must return to his/her station using the means for transportation (FIGS. 7, 8) in accordance with their availability in the area of player's travel. In addition, a brief flyer-guide providing necessary information about the actual orientation in the area each particular embodiment of the game deals with, can be supplied with the game equipment.

Referring to the embodiment of the game dealing with the state of Arizona, let's suppose that the player after collecting a missed playing card in Kingman associated with the station #4 of red itinerary 8 shown in the extreme left-central part of map 3 (FIG. 1) must return to Flagstaff associated with the station 77 having numbers 2–3 of orange itinerary 9 and located in the center of map 3. As it is shown in map 3 according to FIG. 8, Flagstaff and Kingman are related by railroad, bus and air routes; the US interstate highway 40 links between the cities wherein, in both of them, the player can rent a car. For moving between the cities by bus or car, the player must consult a scale of mileage 88 (FIG. 1) and learn that Flagstaff and Kingman are separated by 143 miles. According to the rules of the game related to Arizona, the distance below or equal 70 miles (travelling by car) and below or equal 50 miles (bus service) corresponds respectively to one turn (it is not necessary to throw die). Therefore, the player must use 3 turns while travelling by car and 4 turns using a bus for arriving from Kingman to Flafstaff. As far as a transportation by air or train are concerned, the rules stated that one turn corresponds to travelling from one airport to another and two turns correspond to moving from one train station (indicated on map 3) to another. Consequently, according to the indicia of map 3, the most efficient means for public transportation available between Kingman and Flagstaff will be airplane. Some restrictions to the above rules reflected the conditions of transportation in Arizona may apply. For example, certain playing cards can bear inscriptions "Blowing Dust"; in this case, only travelling by car with one turn corresponding to 50 miles (instead of 70 in normal conditions) and train can be permitted. The moving within the cities comprising the area of Phoenix and Tucson displayed in the separate maps 5 and 6 is authorized only along the itineraries. The players considered to leave these itineraries, must place their tokens on the corresponding stations of the map 3 and to move according to the method explained hereinabove.

It is understood that a tourist should learn a lot about Arizona while riding a car and about New York City while walking. Consequently, in the disclosed embodiment of the game concerning New York City (FIGS. 3, 4) the player while leaving an itinerary, can (as it is in real life conditions in N.Y.C.) walk, use a subway or bus (FIG. 9). As, generally speaking, the visitors in New York do not advise renting a car for movement inside the city in weekdays, the game reflects these conditions.

The player that has to return to his/her itinerary after collecting a missed playing card, has to consult a map 90 shown in FIGS. 3 and 4 where the stations 77 bear the indicia explained in FIG. 9 and where the selected car rental services 60 are also indicated, and choose one of the appropriate means for transportation. For walking in New York City above 14th street (Lower Manhattan, Midtown and Uptown), one turn corresponds to one block. For walking below 14th street, the player have to consult a downtown scale 22 (FIG. 3) wherein 1 turn corresponds to a movement of 0.5 inches or less on the map surface. As far as a travel by car below 14th street is concerned, the scale 22 indicates one turn corresponding to a movement of 2.5 inches or less on the map surface (week-ends) and 1 inch in weekdays. Consequently, to make the player's movement easily below 14th street in the corresponding cases, it seems to be reasonable to fabricate a set of tokens wherein each token (FIG. 14) has a round basis having the diameter equal to 0.5 inch according to the present dimensions of the map 90 shown in FIG. 3; should these dimensions be changed, the indicia of the downtown scale 22 as well as said basis of each said token, serving the present disclosure as the exemplifications only, will be modified correspondingly. Above 14th street the players can move by car according to their needs 6 blocks or less in weekends and 2 blocks or less in weekdays.

If a player decides to travel by bus or subway, he may use the actual bus and/or subway map(s) of Manhattan which can be included in the game equipment, as well as the Transit Table (FIG. 7) showing the connections of the stations 77 of each itinerary (8–12) with the subway and bus systems of New York City as described hereinabove. Next, the player throws die (FIG. 13); the number on a die indicates the exact number of blocks (for moving by bus) or the exact number of the stops indicated on a subway map which the player must move while choosing the subway system; only one throw per turn is permitted. Referring now to FIG. 4, let's suppose that the player, after collecting a playing card in station #6 of orange itinerary 9, having a title 14 which reads "Lincoln Center" has to return to station #1 of violet itinerary 10 having title 14 "Guggenheim Museum". If collected card bears the title "Week End", the better solution will be to move by car. The player now has to inform the other players about means for transportation she/he has choosen. To reach a car rental service located near the corner of West End Avenue and 71st W. street, the player must walk two blocks (this distance corresponds to two turns). He/she then rents a car and uses the third turn (1 turn=6 blocks) for arriving to the corner of the Fifth Avenue and 59th E. street. An additional turn will be needed to reach Guggenheim Museum. However, if the playing card collected in the station associated with Lincoln Center doesn't bear an inscription "Week End", the following strategy of return to the station associated with Guggenheim Museum can be adopted. First, the player consult the Transit Table (FIG. 7) and, eventually, the actual subway and bus maps of New York City. Suppose, the player chooses to take bus #30, throws a die and gets 5 points (this number corresponds to the distance of 5 blocks in the map shown in FIG. 4); the player therefore, leaves the bus in the corner of 5th Avenue/59th E. street, takes the bus #1, throws die, gets, for example, no less than 3 points and arrives at station #1 of violet itinerary 10 (separated by 3 blocks from 59th E. street). If (this supposition serves, of course, the illustration purpose only), the player leaving a bus in the corner of 59th E. str./Fifth Avenue, decides to continue the travel by subway, he must to walk 2 blocks (=2 turns) until Lexington Avenue and take a train #4,5 or 6. If the player now has 3 points on a die, she/he will reach the subway stop in 86 E. str./Lexington Ave. (as on a subway map of N.Y.C. there are three stops between 59th E. and 86th E. streets); because the Transit Table relates this stop with the station #1 of violet itinerary (Guggenheim Museum), the player doesn't have to throw die again.

It is understood that the above rules as well as the other components of the present disclosure dealing with the two different embodiments of the game, has been made only by the way of example and can be developed further or even radically changed. This modifications and variations however, will not change the spirit and basic principles of the invention explained hereinabove.

I therefore claim:

1. A board game apparatus designed to guide the players within an existing geographical place, said apparatus comprising:

a. a board having a playing surface including at least one outline map of said place showing the geographical features and indicia characterizing said place wherein on said map are displayed the itineraries in the form of playing paths, each said itinerary having stations located along its path at selected geographical locations representing attractions, some of said attractions being matched with at least one type of service selected from the group consisting of hotel accommodations, dining, shopping, car renting and entertainment, each said itinerary travel path having a beginning point and distinguishable color indicia associated therewith, said map having a finish point located thereon designating a common finish point for all players;

b. a plurality of playing cards designed to enrich the player's knowledge regarding said place, each said playing card corresponding to one of said stations on one of said itinerary playing paths and each of the cards having color indicia thereon that is substantially the same as the color indicia on the itinerary path that contains the space that corresponds to the card;

c. at least one winning card awarded to the winner of the game in accordance with the rules of the game;

d. at least one token means, each said token means being dedicated to a different player and being moveable for said travel, each token means having color indicia thereon that corresponds to one of the color indicia represented on the playing cards and the itinerary paths;

e. at least one enlarged unit of said map defined in accordance with its existing features, displayed on said board apart from said map, said unit representing an important tourist locality within said place, and comprising at least a portion of at least one of said itinerary travel paths.

2. A board game apparatus as defined in claim 1 further comprising means for direct distribution of said playing cards and control of the speed of movement of said token means in conformity with the rules of the game.

3. A board game apparatus as defined in claim 1 further comprising a non-colored pictoral information concerning said place displayed in comic manner by a multiplicity of designs in the plurality of the geographically corresponding locations on said board, said pictoral information helping to enrich players' knowledge regarding said place and consequently, enhancing the possibility of each player to be a winner as stated in the rules of the game.

4. A game apparatus as defined in claim 3 further including a plurality of coloring means for coloring said designs and those of said features which are non-colored for the purpose to better familarize the players, particularly youngsters, with said place.

5. A game apparatus as defined in claim 1 wherein said playing cards comprise a plurality of different sets of cards, each set being related to different subjects, the different subjects comprising: museums, national monuments, distinguished natural historic and cultural sites; hotel accomodations; shopping; car renting; and restaurants and entertainment.

6. A game apparatus as defined in claim 1 wherein on one face of each said playing card are pictured the patterns of at least one said attraction or said service associated with the definite station, certain said playing cards also bear on their faces the representations of enlarged sections of said map or said unit, each said section showing the immediate geographical vicinities of the definite station associated with said playing card, within said section the exact location of at least one said attraction or said service is indicated, the reverse side of each said playing card providing basic information regarding at least one said attraction or said service and contains some instructions for the purpose of rewarding or penalizing players.

7. A game apparatus as defined in claim 6 wherein a selective part of said information provided on the reverse side of each said playing card is underlined serving for formulating the questions at the end of the game; correct answers to said questions helping to select a winner in accordance with the rules of the game.

8. A board game apparatus as defined in claim 1 further comprising a kit container having a plurality of compartments, certain said compartments serving for holding said playing cards in order to permit their correct distribution between the players in accordance with the rules of the game, said kit also having a pocket for collecting said playing cards which are lost by the players during the course of the game.

9. A board game apparatus as defined in claim 1 having coloring means for coloring parts of said map wherein said compartments are adapted to receive said coloring means.

10. A board game apparatus as defined in claim 1 wherein each said station is coded for the purpose of informing the players about at least one mode of transportation actually existing in the immediate vicinities of said station.

* * * * *

UNITED STATES PATENT AND TRADEMARK OFFICE

CERTIFICATE OF CORRECTION

PATENT NO. : 4,784,394

DATED : Nov. 15, 1988

INVENTOR(S) : Vitaly Sumin

It is certified that error appears in the above-identified patent and that said Letters Patent is hereby corrected as shown below:

Column 2, line 15, after "Arizona Belongs to You" change the semicolon to a comma, and add -- which includes a fragmentary scale of mileage. --.

Column 10, line 23, after "another." insert -- The fragmentary scale of mileage 88 is a representation of part of a conventional mileage scale commonly shown on road maps, from which the distance between two cities on the map can be read. --.

Signed and Sealed this

Fourth Day of April, 1989

*Attest:*

*Attesting Officer*

DONALD J. QUIGG

*Commissioner of Patents and Trademarks*